US010704779B1

(12) United States Patent
Zhang et al.

(10) Patent No.: US 10,704,779 B1
(45) Date of Patent: Jul. 7, 2020

(54) LED HEAT-DISSIPATING DOWNLIGHT

(71) Applicant: XIAMEN ECO LIGHTING CO. LTD., Xiamen (CN)

(72) Inventors: Qiong Qiao Zhang, Xiamen (CN); Yuan Lin Zhou, Xiamen (CN); Zheng Qing Tan, Xiamen (CN); Qi Qing Yu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/365,666

(22) Filed: Mar. 26, 2019

(51) Int. Cl.

| | |
|---|---|
| ***F21V 29/70*** | (2015.01) |
| ***F21S 8/02*** | (2006.01) |
| ***F21V 23/00*** | (2015.01) |
| ***F21V 17/12*** | (2006.01) |
| ***F21V 14/06*** | (2006.01) |
| ***F21V 23/04*** | (2006.01) |
| ***F21V 7/04*** | (2006.01) |
| *F21Y 115/10* | (2016.01) |

(52) U.S. Cl.
CPC ..... *F21V 29/70* (2015.01); *F21S 8/026* (2013.01); *F21V 7/04* (2013.01); *F21V 14/06* (2013.01); *F21V 17/12* (2013.01); *F21V 23/006* (2013.01); *F21V 23/0435* (2013.01); *F21Y 2115/10* (2016.08)

(58) Field of Classification Search
CPC ..... F21K 9/237; F21S 4/28; F21S 8/02; F21S 8/026; F21V 7/04; F21V 14/06; F21V 21/04; F21V 23/006; F21V 23/0435; F21V 25/00; F21V 29/70; F21V 13/04; F21V 29/50; F21Y 2115/10
USPC ..... 362/84, 147, 235, 267, 294, 606, 231, 362/244, 362, 364, 368, 471, 538, 609; 381/173; 313/46; 315/113, 307
See application file for complete search history.

(56) References Cited

U.S. PATENT DOCUMENTS

| | | | | |
|---|---|---|---|---|
| 8,220,970 | B1 * | 7/2012 | Khazi | F21V 29/004 362/294 |
| 9,062,866 | B1 * | 6/2015 | Christ | F21V 21/04 |
| 10,267,503 | B2 * | 4/2019 | Yu | F21V 23/007 |
| 2007/0263393 | A1 * | 11/2007 | Van De Ven | F21V 29/2212 362/362 |
| 2009/0086476 | A1 * | 4/2009 | Tickner | F21S 8/02 362/231 |
| 2009/0097262 | A1 * | 4/2009 | Zhang | F21S 8/026 362/364 |
| 2010/0061108 | A1 * | 3/2010 | Zhang | F21S 8/026 362/364 |

(Continued)

*Primary Examiner* — Gerald Gauthier
(74) *Attorney, Agent, or Firm* — Chun-Ming Shih; Lanway IPR Services

(57) ABSTRACT

A LED heat-dissipating downlight includes an enclosure body, a light source board, and a driving board. The enclosure body has a side opening. The accommodating chamber is substantially made of a heat dissipation material. The light source board and the driving board are disposed in the accommodating chamber. The light source board is disposed on a bottom of the accommodating chamber, and thermally contacted to the accommodating chamber. The driving board is disposed on the light source board. The driving board has a spacing hole, and the light generated by the light source board passes through the spacing hole to the side opening of the accommodating chamber.

9 Claims, 4 Drawing Sheets

(56) References Cited

U.S. PATENT DOCUMENTS

2010/0254121 A1* 10/2010 Zhou ..... G02B 6/0043 362/147
2010/0296301 A1* 11/2010 Xhunga ..... F21S 8/028 362/471
2011/0063849 A1* 3/2011 Alexander ..... F21V 19/001 362/294
2011/0068711 A1* 3/2011 Spiro ..... F21S 2/00 315/307
2011/0222270 A1* 9/2011 Porciatti ..... F21V 23/026 362/147
2011/0228544 A1* 9/2011 Dubord ..... F21S 2/005 362/368
2012/0057364 A1* 3/2012 Kishimoto ..... F21K 9/90 362/538
2012/0106135 A1* 5/2012 Chen ..... F21S 8/04 362/147
2012/0287625 A1* 11/2012 Macwan ..... F21S 8/026 362/235
2013/0010464 A1* 1/2013 Shuja ..... F21V 29/402 362/235
2013/0016511 A1* 1/2013 Mansfield ..... F21K 9/00 362/244
2013/0063937 A1* 3/2013 Ahn ..... F21V 31/005 362/235
2013/0114243 A1* 5/2013 Chu ..... F21S 8/04 362/84
2013/0307399 A1* 11/2013 Kim ..... F21K 9/23 313/46
2014/0056026 A1* 2/2014 Boomgaarden ..... F21K 9/61 362/609
2014/0268800 A1* 9/2014 Castillo ..... F21V 5/02 362/294
2014/0307441 A1* 10/2014 Wu ..... F21V 31/005 362/267
2014/0354155 A1* 12/2014 Clifford ..... F21V 29/02 315/113
2014/0369030 A1* 12/2014 Livesay ..... H01L 33/642 362/147
2015/0098206 A1* 4/2015 Pickard ..... F21K 9/60 362/84
2015/0233537 A1* 8/2015 Athalye ..... F21S 8/026 362/147
2016/0025285 A1* 1/2016 Johnson ..... F21S 8/026 362/294
2016/0154171 A1* 6/2016 Kato ..... F21V 29/508 362/606
2017/0234520 A1* 8/2017 Yu ..... F21V 29/83 362/294
2017/0307143 A1* 10/2017 Shah ..... F21K 9/68
2018/0010779 A1* 1/2018 Zhou ..... F21V 25/00
2018/0119903 A1* 5/2018 Lu ..... F21V 21/025
2019/0120474 A1* 4/2019 Cheng ..... F21V 23/006
2019/0195476 A1* 6/2019 Li ..... F21V 21/047
2019/0257498 A1* 8/2019 Castillo ..... F21S 8/063
2019/0309932 A1* 10/2019 Evans ..... F21V 7/0008

* cited by examiner

LED HEAT-DISSIPATING DOWNLIGHT

BACKGROUND OF THE INVENTION

Field of Invention

The present invention relates to a lighting device, especially a LED heat-dissipating downlight with remote control function.

Description of Related Art

With the most current LED chip manufacturing and packaging technology, the cost of LED components is greatly reduced than the cost before, and LEDs are therefore more and more widely used. In application of lighting, LEDs can save a lot of energy and endure a long life. More and more downlights have used the LED as the light sources; meanwhile, more and more LED downlights are used in our daily life.

However, the current LED downlights require a specific and external heat-dissipating design to transfer the heat from the LED light sources, and a separate drive box is required for accommodating driving components. With necessary arrangement for the heat-dissipating design and the drive box, the structure of the LED downlight becomes complicated, such that it is difficult to achieve a highly automatic production of the LED downlight, and the production efficiency of the LED lamp is therefore at a low level.

SUMMARY OF THE INVENTION

In view of the above, the present invention provides a LED heat-dissipating downlight, including an enclosure body, a light source board, and a driving board. The enclosure body has a side opening. The accommodating chamber is substantially made of a heat dissipation material. The light source board and the driving board are disposed in the accommodating chamber. The light source board is disposed on a bottom of the accommodating chamber, and thermally contacted to side walls of the accommodating chamber. The driving board is disposed on the light source board. The driving board has a spacing hole, and the light generated by the light source board passes through the spacing hole toward the side opening of the accommodating chamber.

Further, a reflection bowl is further disposed in the accommodating chamber. The reflecting cup is facing the side opening of the accommodating chamber, and configured to operably reflect the light generated by the light source board to the side opening.

Further, the LED heat-dissipating downlight further includes a ring plate, and the ring plate is substantially made of a transparent material or a translucent material, and the ring plate is disposed to cover the side opening of the enclosure body, to distribute the light generated by the light source board.

Compared with the prior art, the light source board and the driving board are disposed in the accommodating chamber of the enclosure body, and the driving board is disposed on the light source board. A spacing hole is included on the driving board, for leaving space over the light source board for passing the light. Meanwhile, the light source board is thermally contacted to the bottom of the accommodating chamber, and the heat is therefore transferred to the enclosure body and dissipated by the enclosure body, such that the light source board can exclude the specific heat-dissipating design (for example, heat sink) for transferring the heat.

Further, this arrangement can also exclude the specific drive box for accommodating the driving assembly. Thereby, the heat-dissipating downlight has a simple structure capable of improving assembly efficiency in production.

DESCRIPTION OF THE PREFERRED EMBODIMENTS

The objectives, technical details, features, and effects of the present invention will be better understood with regard to the detailed description of the embodiments below, with reference to the drawings.

Figure 1:
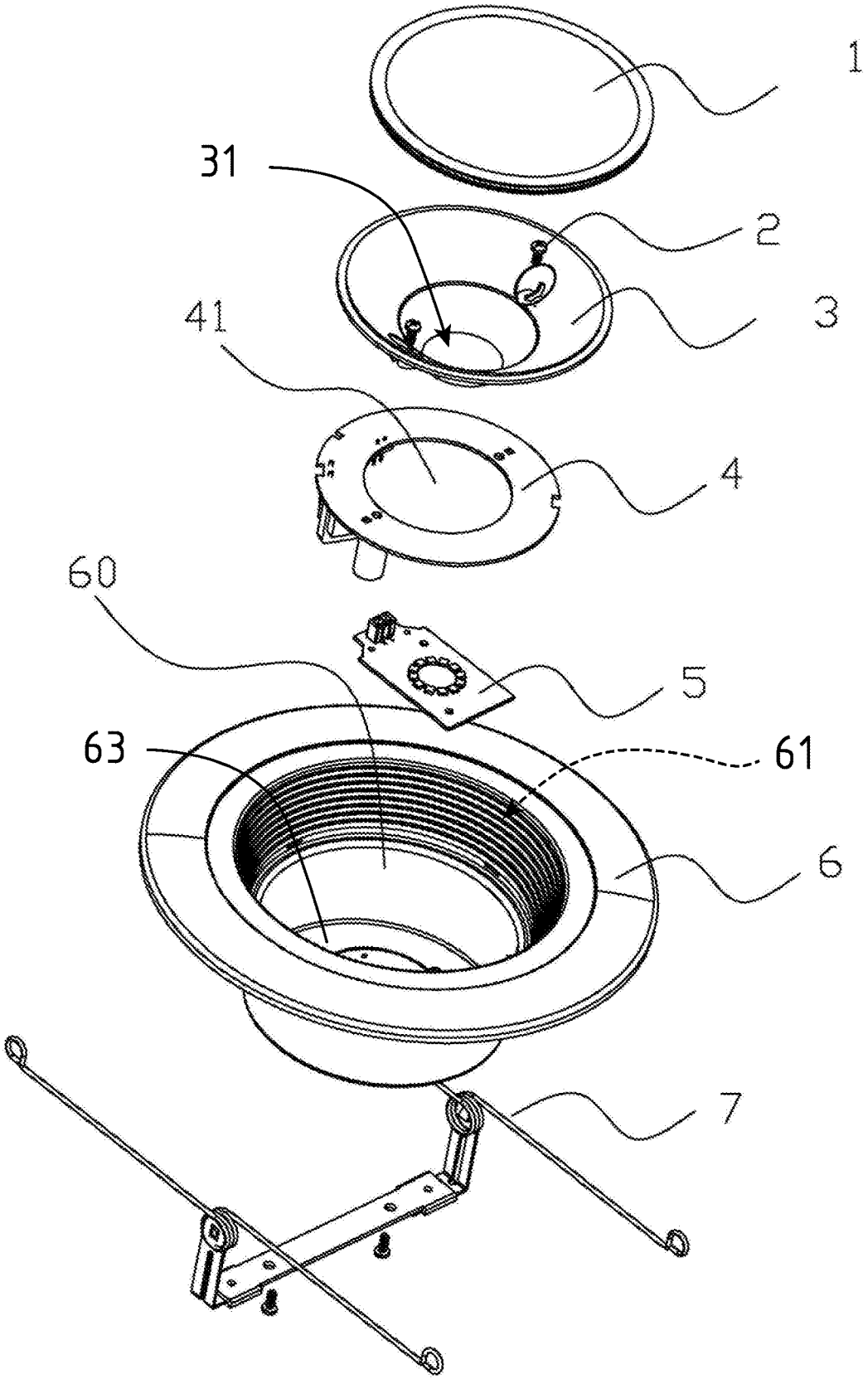
FIG. 1 is a 3D schematic view of a LED heat-dissipating downlight according to one embodiment of the present invention.

Please refer to FIG. 1, the LED heat-dissipating downlight includes a ring plate 1, a plurality of screws 2, a reflective cup 3, a driving board 4, a light source board 5, an enclosure body 6, and a fixing member 7. The enclosure body 6 includes an accommodating chamber 60 having a side opening 61, and the enclosure body 6 is substantially made of a heat dissipation material. The light source board 5 and the driving board 4 is disposed in the accommodating chamber 60. The light source board 5 is disposed on a bottom 63 of the accommodating chamber 60, and has a thermal contact with a side wall of the accommodating chamber 60. The driving board 4 is disposed on the light source board 5, and includes a spacing hole 41 such that the light generated by the light source board 5 is capable of passing through the spacing hole 41 toward the side opening 61 of the accommodating chamber 60. The reflecting cup 3 is disposed in the accommodating chamber 60 by the screws 2. The reflection bowl 3 is configured to operably reflect the light from the light source board 5 toward the side opening 61 of the accommodating chamber 60. The ring plate 1 is disposed to cover the side opening of the enclosure body 6, to distribute the light from the light source board 5. The fixing member 7 is fixed to the enclosure body 6 by the screw 2 and away from a bottom opening of the enclosure body 6, for leaving space to a power cable (not shown) or other wirings.

Figure 2:
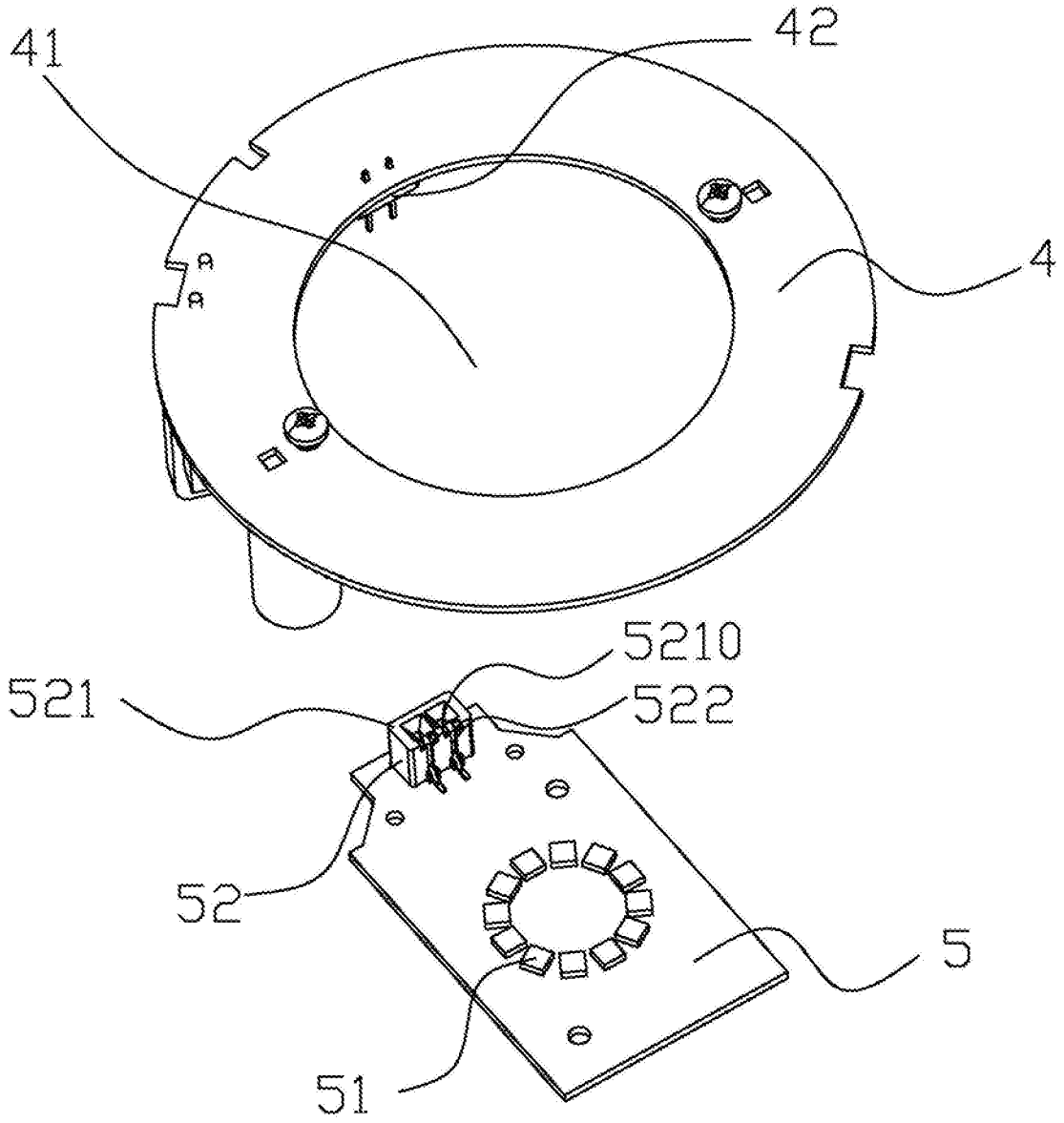
FIG. 2 is a schematic view showing the light source board and the driving board before assembly process.
Figure 3:
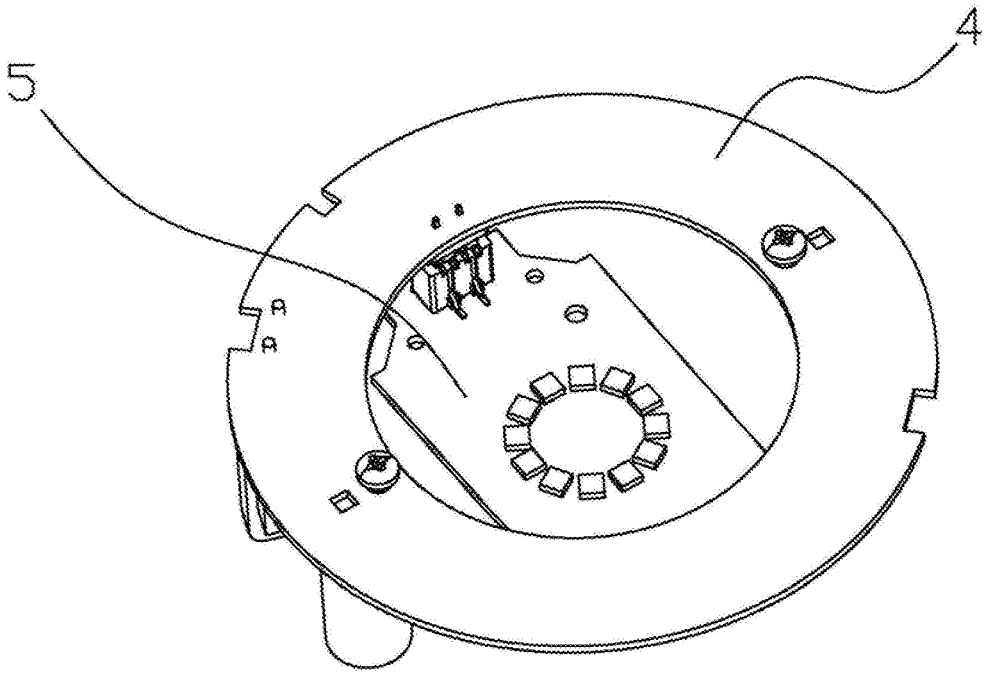
FIG. 3 is a schematic view showing the light source board and the driving board after assembly process.

Referring to FIGS. 1 to 3, the enclosure body 6 includes a shell structure forming the accommodating chamber 60 with the side opening 61. The accommodating chamber 60 may include a cylindrical shape, such that an area of the side opening 61 on a top of the accommodating chamber 60 is larger than the area of the bottom 63 of the accommodating chamber 60. The bottom 63 of the accommodating chamber 60 includes the bottom opening (not shown). The power cable (not shown) is electrically connected to the driving board 4, and passes through the bottom opening to electrically connect an external power supply (not shown). A plurality of LED light sources 51 are disposed on the light source board 5. The light source board 5 is disposed on the bottom 63 of the accommodating chamber 60 of the enclosure body 6, and is thermally contacted to the side wall of the accommodating chamber 60. For obtaining a better heat transfer efficiency between the light source board 5 and the enclosure body 6, a thermal conductive adhesive (not shown) may be distributed between and used to thermally contact the light source board 5 and the enclosure body 6. Thereby, the heat generated by the LED light source 51 can be highly transferred through the light source plate 5 to an outside of the enclosure body 6. Because of the thermal connection between the light source board 5 and the enclosure body 6 in the present invention, the prior heat sink in the prior light source board can be excluded. The light source board 5 includes a female terminal 52, and the female terminal 52 is electrically connected to the LED light sources 51. The female terminal 52 comprises a fixing receptacle 521 and an elastic electrode 522. The fixing receptacle 521 is made of an insulating material, and includes a receiving slot 5210. The elastic electrode 522 is located in the receiving slot 5210. The female terminal 52 is configured to electrically connect to the driving board 4.

Referring to FIGS. 1 to 4, when assembling the LED heat-dissipating downlight, a side of the driving board 4 having components is disposed to face the light source board 5. The driving board 4 is fixed to the bottom 63 of the accommodating chamber 60 by the screws 2. The driving board 4 is disposed on the light source board 5 and has a spacing hole 41 at a center of the driving board 4. In the figures, the spacing hole 41 is circular, and the light from the LED light sources 51 located on the driving board 4 can pass through the spacing hole 41, toward the side opening 61 of the accommodating chamber 60. It can be understood that in some other embodiments, the shape of the spacing hole 41 may be in other shapes such as a square or a polygon based on implementation requirements. The drive board 4 has a male terminal on a location corresponding to the female terminal 51. The male terminal 41 includes a metal rod structure, and one end of male terminal 41 is electrically connected to the driving board 4, and the other end of the male terminal 41 is inserted into the receiving slots 5210 and elastically pressed on the elastic electrode 522. Thereby, the male terminal 41 is electrically connected to the female terminal 52 such that the driving board 4 is electrically connected to the light source board 5. The driving board 4 and the light source board 5 are both disposed on the bottom 63 of the accommodating chamber 60, and electrically connected to each other through the male terminal 41 and the female terminal 52. Therefore, the step of installing the prior drive box is excluded.

Importantly, the male and female terminals according to the present invention can be not limited to the disposition arrangement shown in figures. For example, the dispositions of the male and female terminals can be exchanged, which similarly provides electrical connection between the driving board and the light source board.

Referring to FIG. 1, the reflection bowl 3 is a shell structure with a small bottom. The reflection bowl 3 is disposed in the accommodating chamber 60. The small bottom of the reflection bowl 3 passes through the spacing hole 41 and includes a hole 31 to surround the LED light source 51. The reflection bowl 3 is configured to operably reflect the light from the light source board 5, toward the side opening 63 of the accommodating chamber 60. The reflection bowl 3 is fixed to the driving board 4 by the screws 2. Please refer to FIG. 1, the ring plate 1 is substantially made of a transparent material or a translucent material, and the ring plate 1 is disposed to cover the side opening of the enclosure body 6, to distribute the light from the light source board 5. The fixing member 7 is fixed to the enclosure body 6 by the screws 2, and far away from the bottom 63 of the enclosure body 6. The fixing member 7 is configured to fix the LED heat-dissipating downlight in the corresponding hole on the ceiling or other places.

In the aforementioned embodiment, the ring plate 1 is substantially made of a transparent material or a translucent material, which means a large portion of the ring plate 1 is made of the transparent material or translucent material, and rest portion of the ring plate 1 may be a component for fixing the ring plate 1 on the enclosure body 6. The transparent material provides a clear light path without light distortion effect through the ring plate 1. The translucent material can be a semi-transparent material capable of scattering light through the ring plate 1.

Figure 4:
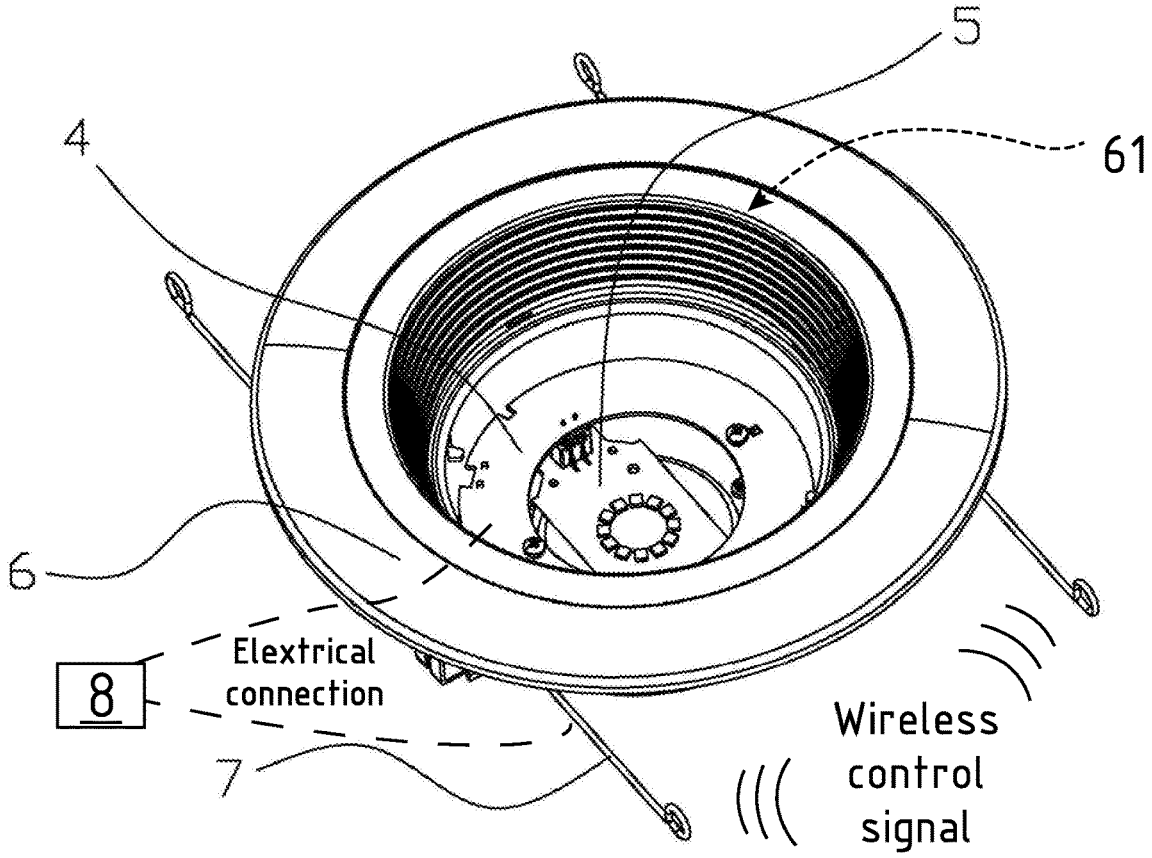
FIG. 4 illustrates a LED heat-dissipating downlight according to one embodiment of the present invention.

Please refer to FIG. 4, in one embodiment, the fixing member 7 includes an antenna function, for receiving a wireless control signal outside of the LED heat-dissipating downlight, for controlling several functions of the LED heat-dissipating downlight.

Figure 5:
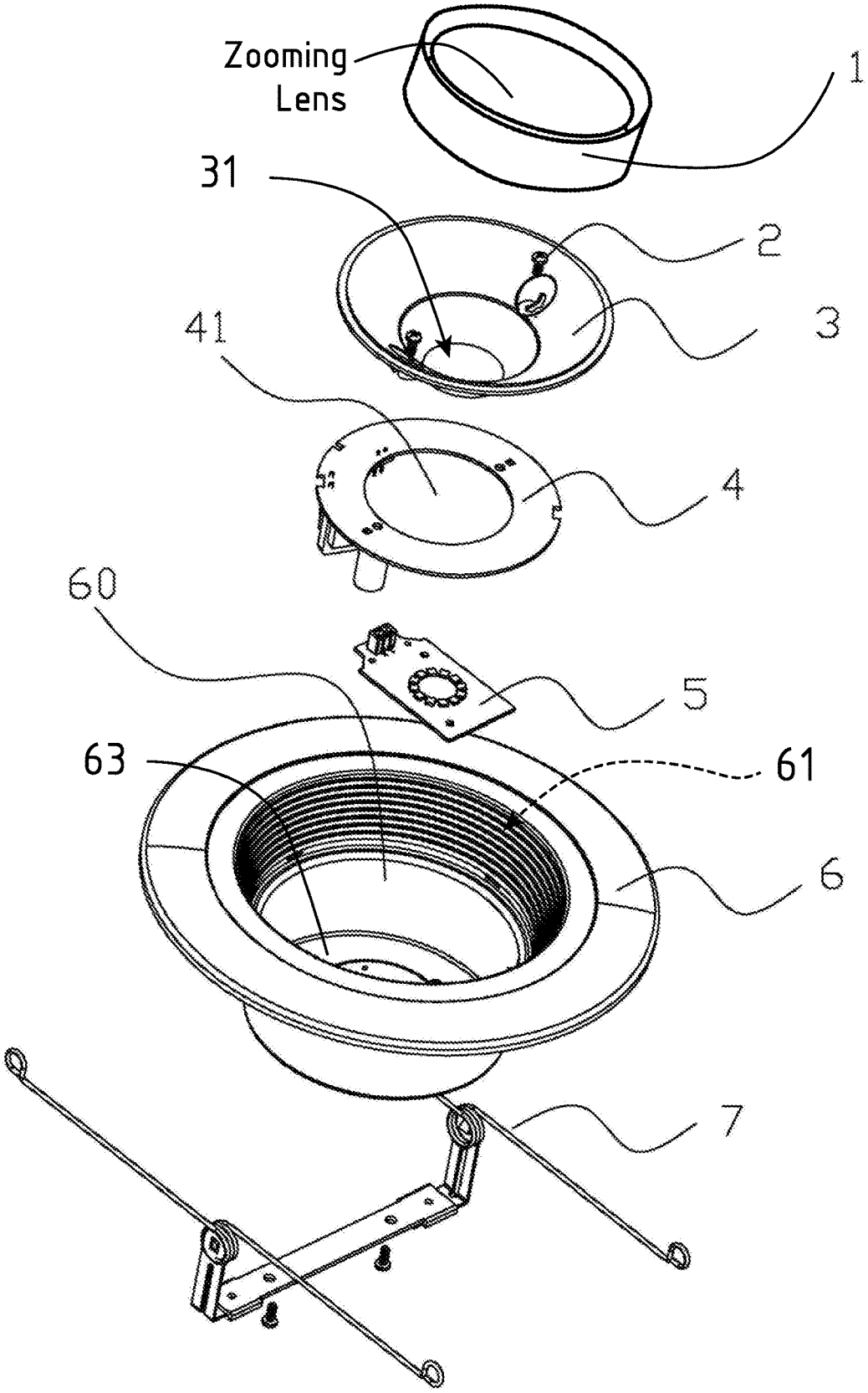
FIG. 5 illustrates a 3D schematic view of a LED heat-dissipating downlight with another design of the ring plate according to one embodiment of the present invention.

In one example, the ring plate 1 can be not limited to the embodiment shown in FIG. 1. In FIG. 5, the ring plate 1 includes a zooming lens for controlling the light distribution from the light source board 5 according to a remote control signal, wherein the ring plate 1 is electrically connected to the fixing member 7 for receiving the remote control signal. With this remote control signal, a user can control the LED heat-dissipating downlight to adjust a zooming function of the light from the light source board 5, without pressing any button or switch having a wired connection with the LED heat-dissipating downlight.

Please refer to FIG. 4, in another example, the LED heat-dissipating downlight further includes a downlight remote switch controller 8 which is electrically connected to the driving board, for turning on or off the light source board to emit the light. The remote switch controller 8 is electrically connected to the fixing member for receiving a wireless control signal.

In view of two aforementioned examples, the user can easily control the LED heat-dissipating downlight to adjust the zooming lens, or to turn on/off the LED heat-dissipating downlight to emit the light.

In view of the above, the step of installing the heat dissipating component on the light source board 5, and the drive box accommodating the driving assembly, can be excluded by: the light source board 5 and the driving board 4 are accommodated in the accommodating chamber 60 of the enclosure body 6, disposing the light source board 5 on the bottom 63 of the accommodating chamber 60 and thermally contacting the light source board 5 with the side wall of the accommodating chamber 60, and heat dissipating by the shell structure of the enclosure body 6 itself. The design according to the present invention also has the benefit of simple structure of the LED heat-dissipating downlight and improving the production efficiency.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention.

What is claimed is:

1. A LED heat-dissipating downlight, comprising:

an enclosure body, substantially made of a heat dissipation material, the enclosure body including an accommodating chamber with a side opening;

a light source board, disposed on a bottom of the accommodating chamber, and having a thermal contact with a side wall of the accommodating chamber;

a driving board, disposed in the accommodating chamber to be on the light source board, the driving board including a spacing hole, wherein the light from the light source board passes through the spacing hole toward the side opening of the accommodating chamber; and a reflection bowl, which is disposed in the accommodating chamber, and configured to reflect the light from the light source board toward the side opening of the accommodating chamber, wherein the light source board includes an LED light source, and the reflection bowl is a shell structure with a small bottom, wherein the small bottom of the reflection bowl passes through the spacing hole and includes a hole to surround the LED light source.

2. The LED heat-dissipating downlight of claim 1, wherein the reflection bowl is fixed to the driving board.

3. The LED heat-dissipating downlight of claim 1, further comprising a plurality of screws, wherein the driving board is fixed to the bottom of the accommodating chamber by the plurality of screws.

4. The LED heat-dissipating downlight of claim 3, wherein the driving board includes a first terminal, and the light source board includes a second terminal, and the first terminal is electrically connected to the second terminal for electrically connecting the driving board with the light source board, wherein the first and second terminals are a group of the male and female terminals.

5. The LED heat-dissipating downlight of claim 4, wherein the female terminal comprises a fixing receptacle and an elastic electrode, and the fixing receptacle is made of an insulating material and includes a receiving slot, and the elastic electrode is disposed in the receiving slot; wherein the male terminal includes a metal rod structure, and one end of the male terminal is configured to be inserted into the receiving slot and elastically pressed on the elastic electrode.

6. The LED heat-dissipating downlight of claim 1, further comprising a ring plate, which is substantially made of a transparent material or a translucent material, and the ring plate is disposed to cover the side opening of the enclosure body, to distribute the light from the light source board.

7. The LED heat-dissipating downlight of claim 1, further comprising a fixing member, fixed to the enclosure body and far away from a bottom of the enclosure body.

8. The LED heat-dissipating downlight of claim 7, further comprising a ring plate to cover the side opening of the enclosure body, for distributing the light from the light source board, wherein the fixing member comprises an antenna function, and the ring plate comprises a zooming lens, which is electrically connected to the fixing member for receiving a wireless control signal for controlling the zooming function.

9. The LED heat-dissipating downlight of claim 7, wherein the fixing member comprises an antenna function, and the LED heat-dissipating downlight further comprises a remote switch controller which is electrically connected to the driving board, for turning on or off the light source board to emit the light, wherein the remote switch controller is electrically connected to the fixing member for receiving a wireless control signal.

* * * * *